US006028494A

United States Patent [19]

May et al.

[11] Patent Number: 6,028,494

[45] Date of Patent: Feb. 22, 2000

[54] HIGH ISOLATION CROSS-OVER FOR CANCELING MUTUALLY COUPLED SIGNALS BETWEEN ADJACENT STRIPLINE SIGNAL DISTRIBUTION NETWORKS

[75] Inventors: Jeffery C. May, Indialantic; Walter M. Whybrew, Palm Bay; Douglas E. Heckaman, Indialantic, all of Fla.

[73] Assignee: Harris Corporation, Melbourne, Fla.

[21] Appl. No.: 09/010,654

[22] Filed: Jan. 22, 1998

[51] Int. Cl.[7] ..... H01P 3/08; H01P 5/12

[52] U.S. Cl. ..... 333/1; 333/128; 333/136; 333/246

[58] Field of Search ..... 333/1, 238, 246, 333/128, 136

[56] References Cited

U.S. PATENT DOCUMENTS

| | | | |
|---|---|---|---|
| 3,104,363 | 9/1963 | Butler | 333/246 |
| 5,003,273 | 3/1991 | Oppenberg | 333/1 |
| 5,021,755 | 6/1991 | Gustafson | 333/128 |
| 5,153,602 | 10/1992 | DuBois et al. | 343/853 |
| 5,296,651 | 3/1994 | Gurrie et al. | 174/254 |
| 5,600,285 | 2/1997 | Sachs et al. | 333/1 |

FOREIGN PATENT DOCUMENTS

| | | | |
|---|---|---|---|
| 86302 | 5/1984 | Japan | 333/246 |

*Primary Examiner*—Benny Lee
*Attorney, Agent, or Firm*—Charles E. Wands

[57] ABSTRACT

A stripline isolation cross-over is configured to cancel signals that may be mutually coupled at cross-over points between adjacent stripline networks within a compact multilayer signal distribution architecture, such as one feeding elements of phased array antennas, without a shielding layer between adjacent signal distribution networks. The signal distribution networks includes layers of stripline, patterned on opposite sides of a dielectric layer. Wherever the stripline layers mutually overlap, they are oriented at right angles to one another, and one of the striplines is configured as a pair of power dividers, connected back-to-back via stripline interconnect passing the other stripline layer, to form a signal splitting-recombining stripline pair. The locations where the sections of interconnect cross the second stripline are spaced apart by a half-wavelength of transported signals, so that any signal mutually coupled between the two striplines at each cross-over point will combine antiphase with itself, thereby effectively preventing mutual interference between the two networks.

11 Claims, 4 Drawing Sheets

HIGH ISOLATION CROSS-OVER FOR CANCELING MUTUALLY COUPLED SIGNALS BETWEEN ADJACENT STRIPLINE SIGNAL DISTRIBUTION NETWORKS

FIELD OF THE INVENTION

The present invention relates in general to communication systems, and is particularly directed to a new and improved stripline isolation cross-over, that is configured to effectively cancel signals that may be coupled between mutually overlapping stripline sections of a multilayer signal distribution architecture, thereby effectively preventing mutual interference.

BACKGROUND OF THE INVENTION

Modular communication systems, such as those used in spaceborne and airborne applications, typically employ highly compact and densified signal distribution/feed networks, such as multilayer stripline networks, to interconnect various components, such as RF signal processing (amplifier and impedance/phase control) circuits and beamforming circuits for a phased array antenna. To minimize size and weight, it is common practice to stack multiple ones of such microstrip or stripline configured signal distribution networks as closely together as possible in a common support structure, such as in a laminated arrangement of printed circuits. A simplified illustration of such a laminated structure is diagrammatically illustrated in FIGS. 1 and 2 as patterns of conductors 1 and 2 and intermediate dielectric layers 3 (See FIG. 1), that are stacked together to form a three dimensional signal distribution architecture.

Because high frequency signal distribution networks, such as those employed for (RF) signalling applications in the hundreds of MHz or into the high GHz range, readily couple (radiate and receive) substantial electromagnetic energy in addition to that which is transmitted through the conductors of the networks, it is necessary to carefully configure and/or space such networks with respect to one another and adjacent system components. In FIGS. 1 and 2, this internal separation is shown by horizontal spacing 4 and vertical spacing by way of dielectric material 3 between respective conductors 1 and 2. As far as the environment outside the network is concerned, the signal coupling problem is addressed by the use of (grounded) shielding layers, shown at 5 and 6 in FIG. 1.

However, within the multilayer structure itself, it can be expected that conductors of the respective networks will cross over or overlap one another at or more locations, one of which is shown at 7 in FIG. 2. Because of the relatively reduced vertical separation between the conductors of the respective layers of the laminate, unwanted mutual coupling or cross-talk between the networks will occur at these cross-over points. A customary practice to solve this problem, diagrammatically illustrated in FIG. 3, is to insert a ubiquitous (grounded) conductive shielding layer (e.g., a layer of copper) 8 between each signal distribution layer. The shielding layer 8 is separated from respective conductors 1 and 2 by layers of dielectric material 3. As in FIG. 1, grounded shielding layers 5 and 6 are disposed atop and beneath conductors 1 and 2 by layers of dielectric material 3 therebetween.

Unfortunately, this not only adds weight, but substantially increases the overall thickness of the laminate, as additional dielectric material must be interposed between each intermediate shielding layer and a respective stripline layer. Moreover, the desire to keep such a laminate structure as thin as possible is countered by a trade-off between the thickness of the dielectric between the stripline and the ground layer and the lossiness of the stripline. Namely, because the effective impedance of the stripline is dependent upon its proximity to a ground layer, the thinner the dielectric, the narrower the line width of the stripline must be, in order to maintain a desired characteristic line impedance (e.g., fifty ohms, nominal). However, reducing the cross-section of the stripline increases its resistance and therefore its lossiness.

SUMMARY OF THE INVENTION

In accordance with the present invention, the above-described cross-talk problem is successfully addressed by means of a new and improved stripline isolation cross-over, which is configured to effectively cancel signals that may be coupled between mutually overlapping adjacent stripline networks within a compact multilayer signal distribution architecture, such as one used to feed respective elements of a pair of phased array antennas, but without the need for an intermediate grounded shielding layer between adjacent signal distribution networks.

Each signal distribution network comprises a layer of stripline, such as a layer of fifty-ohm copper transmission line, patterned on a first side of a first dielectric layer. A second signal distribution network comprises a second layer of stripline patterned on a second side of the dielectric layer, with one or more regions of the two patterned stripline layers overlapping each other in mutual projection, between signal input ports to multiple signal output ports of each distribution network.

Wherever stripline layers mutually overlap, they are oriented at right angles to one another, to minimize the area of mutual coupling of one section of stripline to another. In addition, at each region of overlap, one of the two stripline layers contains a pair of signal-splitting (2:1) power dividers, coupled back-to-back, via sections of stripline interconnect passing over or under the other stripline layer, to form a signal splitting-recombining stripline pair.

This power dividing-recombination splitter pair performs antiphase recombination of two mutually coupled signals, so as to effectively cancel cross-talk between the two stripline networks. Antiphase mutual coupling is achieved by electrically spacing the sections of stripline interconnect between the two splitters by 180° or by a half-wavelength of the signal at those locations where they pass (over or under) the other stripline layer. This causes any signal mutually coupled between the two stripline sections at each cross-over point to combine antiphase with itself as mutually coupled between the two stripline sections at the other cross-over point, thereby effectively canceling crosstalk and thereby preventing mutual interference at locations of overlap between the stripline sections of the two distribution networks.

To eliminate signal reflections from the mutual coupling points, respective (fifty-ohm) stripline tuning pads are formed on the dielectric layer parallel to the stripline layers, and spaced apart from the via sections of stripline interconnect joining the power dividers by a distance approximately equal to a quarter wavelength of the transported signals. To complete the laminate architecture, a first shielding ground layer is ubiquitously formed on the outer surface of a second dielectric layer overlying the first stripline section, and a second shielding ground layer is formed on the outer surface of a third dielectric layer overlying the second stripline section.

Respectively different spatial configurations of a signal distribution network employing the stripline cross-over of the present invention may be defined such that adjacent networks, when mutually overlaid in a compact laminate structure, provide separate access to signal input ports, and allow the respective output ports thereof to be placed in a desired spatial arrangement, such as at antenna elements of a phased array antenna, but without signals distributed by any one network being coupled to any of the output ports of any other network.

DETAILED DESCRIPTION OF THE PREFERRED EMBODIMENT

As described above, the stripline isolation cross-over of the present invention is configured to support two or more signal distribution networks in overlapping relationship in a compact laminate structure, without the need for an intermediate grounded shielding layer between adjacent signal distribution networks. For purposes of reducing the complexity of the drawings, a two network architecture will be described as a non-limiting example. It is to be understood, however, that the invention is not limited to use with this or any particular number of signal distribution networks that may be arranged or stacked in mutually overlapping relationship within a laminate structure.

Figure 4:
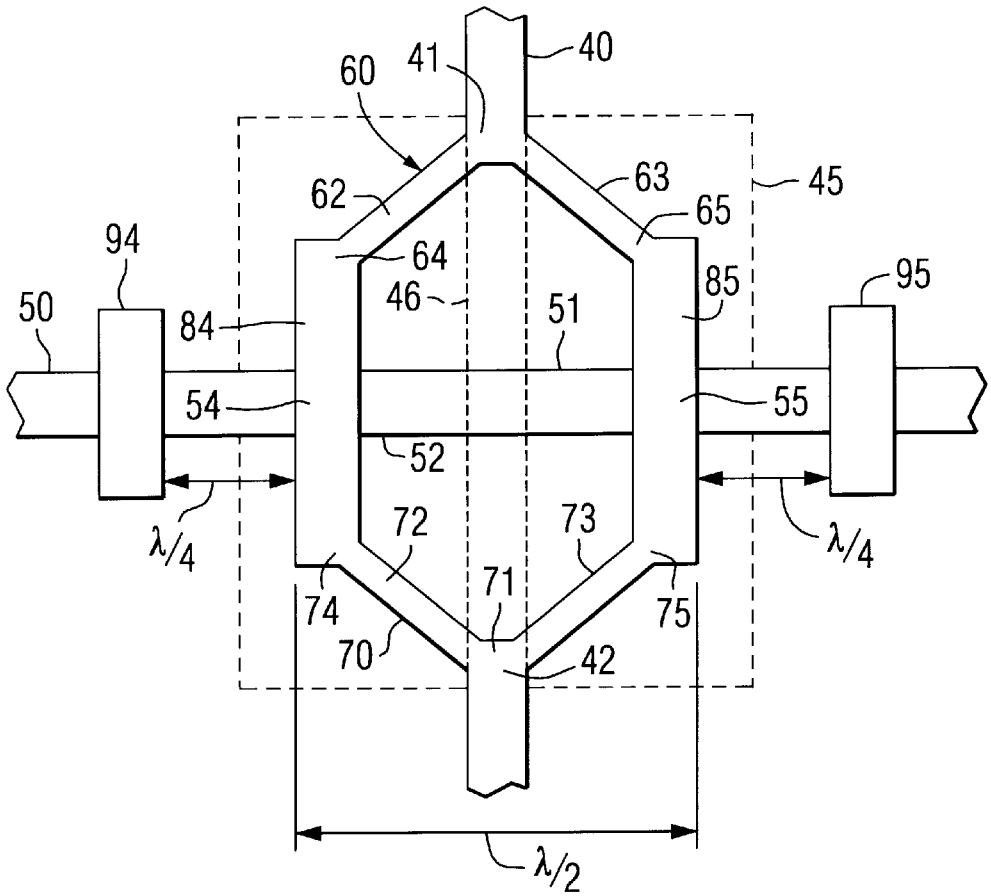
FIGS. 4 and 5 are respective diagrammatic plan and side views of a stripline isolation cross-over of the present invention.
Figure 5:
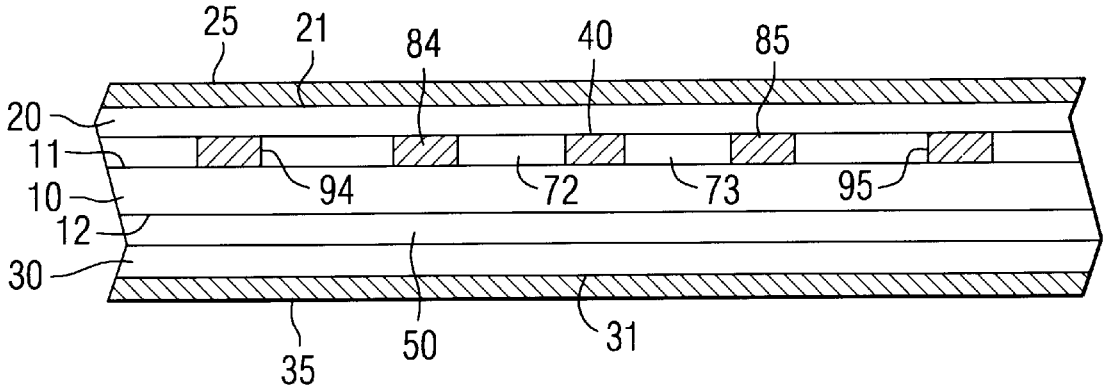

FIG. 4 is a diagrammatic plan view and FIG. 5 is a diagrammatic side view of a multilayer laminate architecture employing the stripline isolation cross-over of the present invention, and configured to support a pair of generally parallel, and overlapping signal distribution networks, such as those used to feed the respective elements of a pair of phased array antennas. As shown therein, the multilayer laminate structure has a first, relatively central dielectric layer 10, and second and third dielectric layers 20 and 30, respectively on first and second (opposite) sides 11 and 12 of the intermediate dielectric layer 10.

Figure 1:
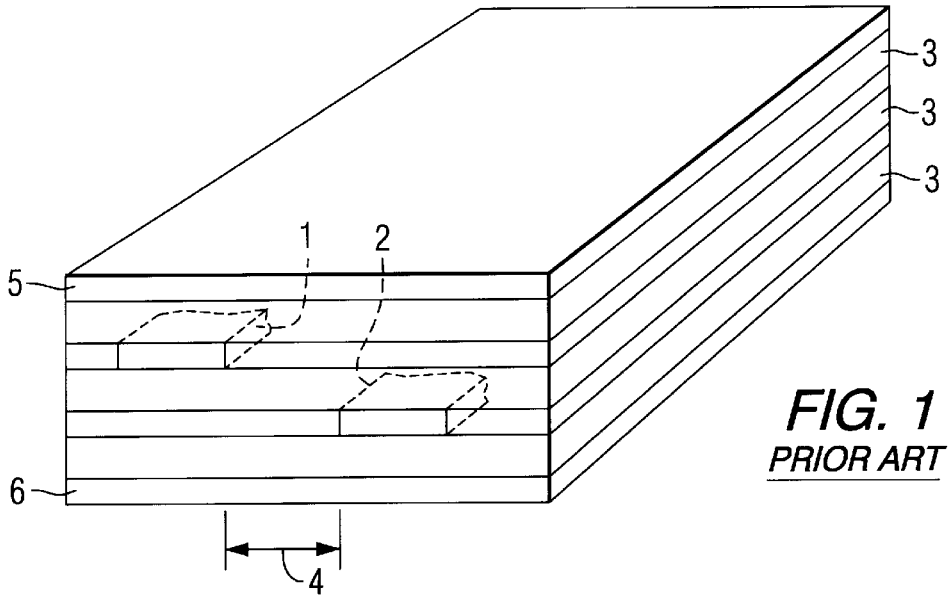
FIG. 1 PRIOR ART
FIGS. 1 and 2 are simplified diagrammatic perspective and plan illustrations of a conventional laminated signal distribution architecture containing overlapping stacked stripline layers.
Figure 2:
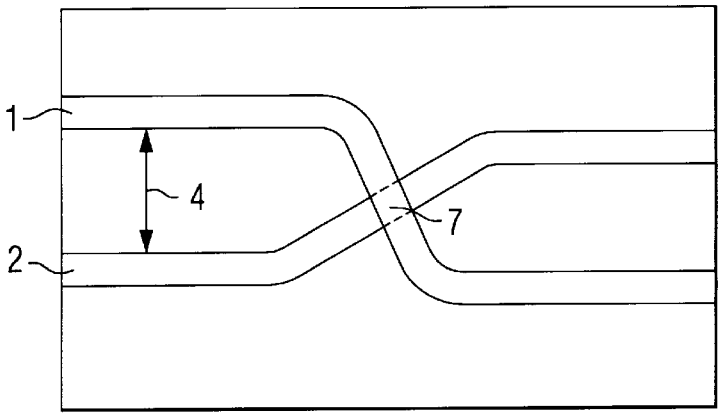
FIG. 2 PRIOR ART
Figure 3:
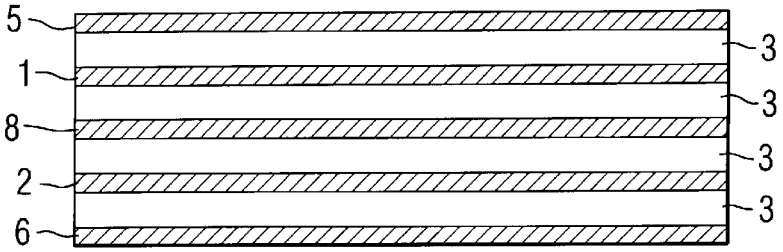
FIG. 3 PRIOR ART
FIG. 3 is a diagrammatic side view of a conventional laminated signal distribution architecture having a conductive shielding layer between adjacent signal distribution layers.

A first of the two signal distribution networks comprises a patterned layer of stripline 40 (also seen in FIG. 1), such as a layer of (fifty-ohm characteristic impedance) copper transmission line, patterned on the first side 11 of the first dielectric layer 10. The second signal distribution network comprises a second stripline 50 (also seen in FIG. 4) patterned on the second side 12 of the dielectric layer 10, such that one or more regions of the two patterned stripline layers mutually overlap each other, as they traverse their way on opposite surfaces 11 and 12 of the dielectric layer 10 from signal input ports to multiple signal output ports of each distribution network.

In accordance with the present invention, wherever routing of the stripline layers 40 and 50 of the two distribution networks causes them to mutually overlap, the stripline sections are arranged so that they are spatially oriented at right angles to one another, as shown in FIG. 4 at region 45, to minimize the area of mutual coupling of one section of stripline to another. In addition, at each area of mutual overlap 45, the normally generally rectilinear configuration of one of the two stripline layers is changed to that of a pair of signal-splitting (2:1) power dividers, such as a pair of power dividers, coupled back-to-back, via sections of stripline interconnect passing (over or under) the other stripline layer, to form a signal splitting-recombining stripline pair.

The purpose of this power divider-recombiner pair is to replace a single mutual coupling point between the two stripline layers at the overlap region 45 with a pair of mutual coupling points, and perform antiphase recombination of two mutually coupled signals, so as to effectively cancel cross-talk between the two striplines at each overlapping region 45. As described previously, antiphase mutual coupling is achieved by electrically spacing apart the sections of stripline interconnect between the two splitters by 180° or by a half-wavelength of the signal, at those locations where they pass (over or under) the other stripline layer.

More particularly, FIGS. 4 and 5 show a modification of that portion of the first section of stripline 40 within overlapping region 45, wherein what would normally be a generally linear region, shown in FIG. 4 at dotted lines 46, is replaced by first and second signal splitters, shown in FIG. 4 as interconnected (2:1) power dividers 60 and 70. The first power divider 60 is readily patterned of the same conductor material as the stripline 40 on the first side 11 of the dielectric layer 10 and, as shown in FIG. 4, has a common port 61 coupled to a first interrupted end portion 41 of the stripline 40 spaced apart from a first side 51 of the second stripline layer 50. Respective (70 ohm) power dividing sections 62 and 63 of the first power divider 60 extend from its common port 61 to divided power ports 64 and 65 thereof.

Similarly, as shown in FIG. 4, the second power divider 70, which is also patterned on the first side 11 of the dielectric layer 10, has a common port 71 coupled to a second interrupted end portion 42 of the stripline 40, spaced apart from a second side 52 of the second stripline layer 50. Respective (70 ohm) sections 72 and 73 (also shown in FIG. 5) of the second power divider 70 extend from its common port 71 to divided power ports 74 and 75 thereof. It should be noted, that unlike a conventional Wilkinson power divider, each of power dividers 60 and 70 is exclusive of a resistor normally bridging its two divided power ports.

In order to interconnect the power divided ports of the two power dividers, respective (50 ohm) stripline layers 84 and 85 are patterned on the first side 11 of the dielectric layer 10 parallel to the stripline section 40, so as to cross over the second section of stripline 50 at locations 54 and 55. Opposite ends of the stripline layers 84 and 85 are coupled to the divided power ports 64 and 65 of the first power divider 60 and the divided power ports 74 and 75 of the second power divider 70, respectively. As described above, the cross-over locations 54 and 55 of the stripline layers 84 and 85 are spaced apart from one another by a half-wavelength of signals transported by the stripline, so that any signal mutually coupled between the two stripline sections 40 and 50 at cross-over point 54/55 will combine antiphase with itself as mutually coupled between the two stripline sections 40 and 50 at cross-over point 55/54, thereby effectively canceling crosstalk and thereby preventing mutual interference at locations of overlap between the stripline sections of the two distribution networks.

To eliminate signal reflections from the mutual coupling points 54 and 55, respective (electrically floating, fifty ohm) stripline tuning pads 94 and 95 (see FIGS. 4 and 5) are formed on the first side 11 of the dielectric layer 10 parallel to the stripline layers 84 and 85, and spaced apart from the stripline layers 84 and 85 by a distance approximately equal to a quarter wavelength of the transported signals (see FIG. 5). As shown in the side view of FIG. 5, to complete the stripline laminate architecture, a first shielding ground layer 25, such as a layer of copper, is ubiquitously formed on the outer surface 21 of the second dielectric layer 20, and a second shielding ground layer 35 is similarly formed on the outer surface 31 of the third dielectric layer 30. These two ground-coupled shielding layers 25 and 35 provide electrical isolation between the signal distribution networks of the laminate architecture and the external environment. Since a respective crosstalk-canceling splitter-recombiner pair is provided wherever the two distribution networks overlap, no additional grounded shielding layer or accompanying dielectric support layer is required.

Figure 6:
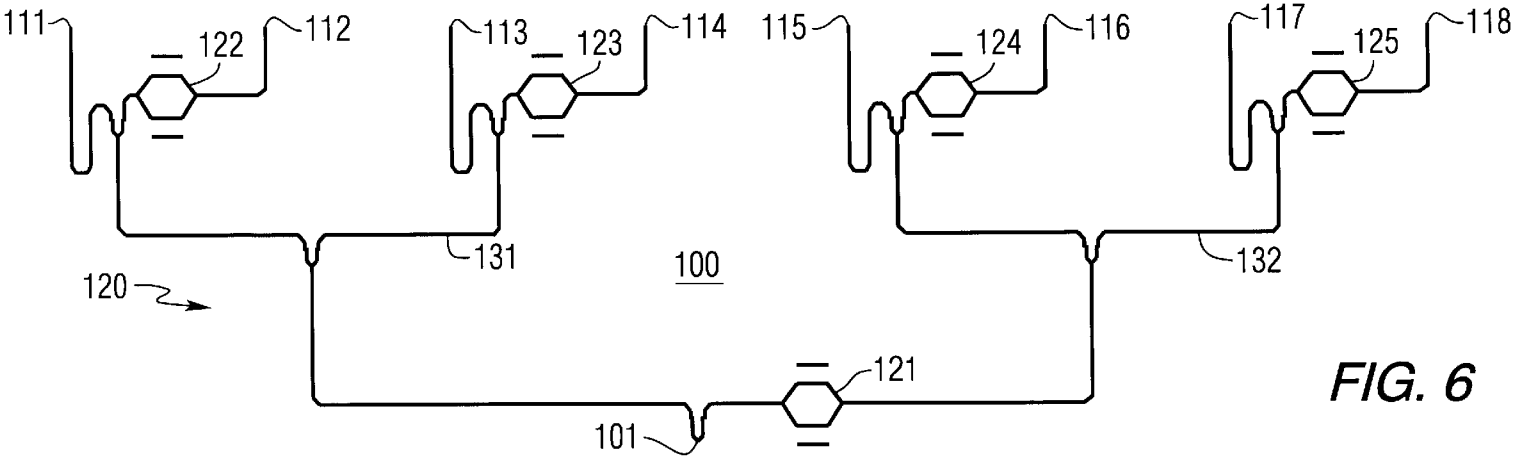
FIGS. 6, 7 and 8 are plan views of a multilayer signal distribution stripline architecture employing multiple ones of the stripline isolation cross-over of the type shown in FIGS. 4 and 5, that provide isolation for a pair of eight-way power dividers installed in a common laminate structure.
Figure 7:
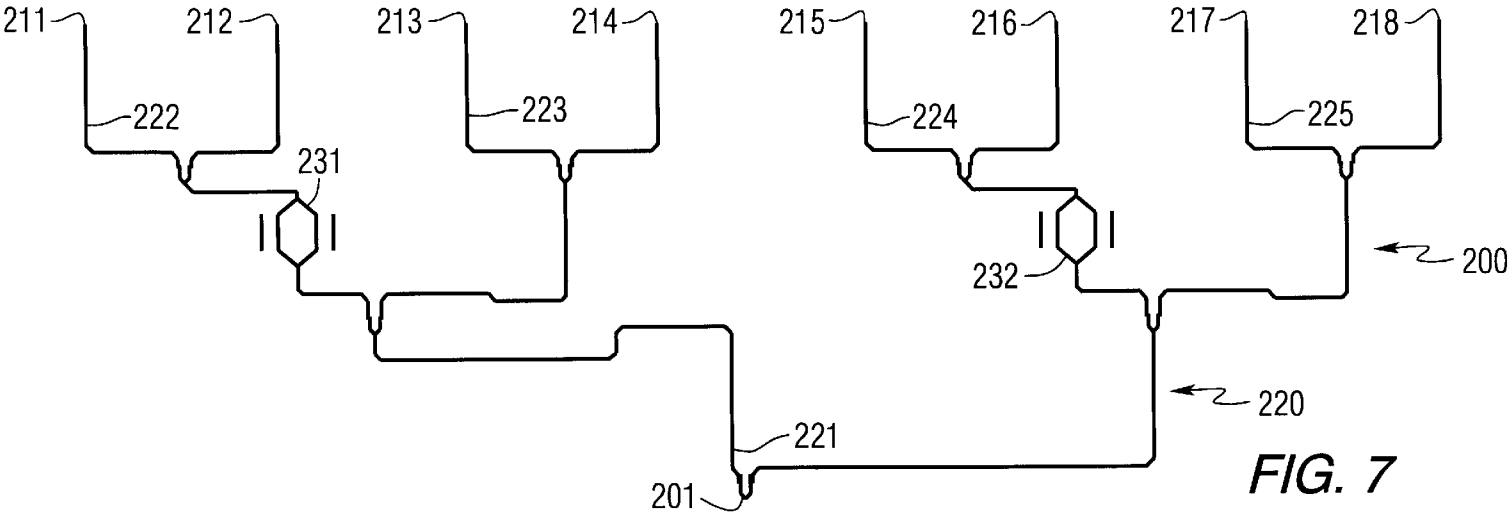
Figure 8:
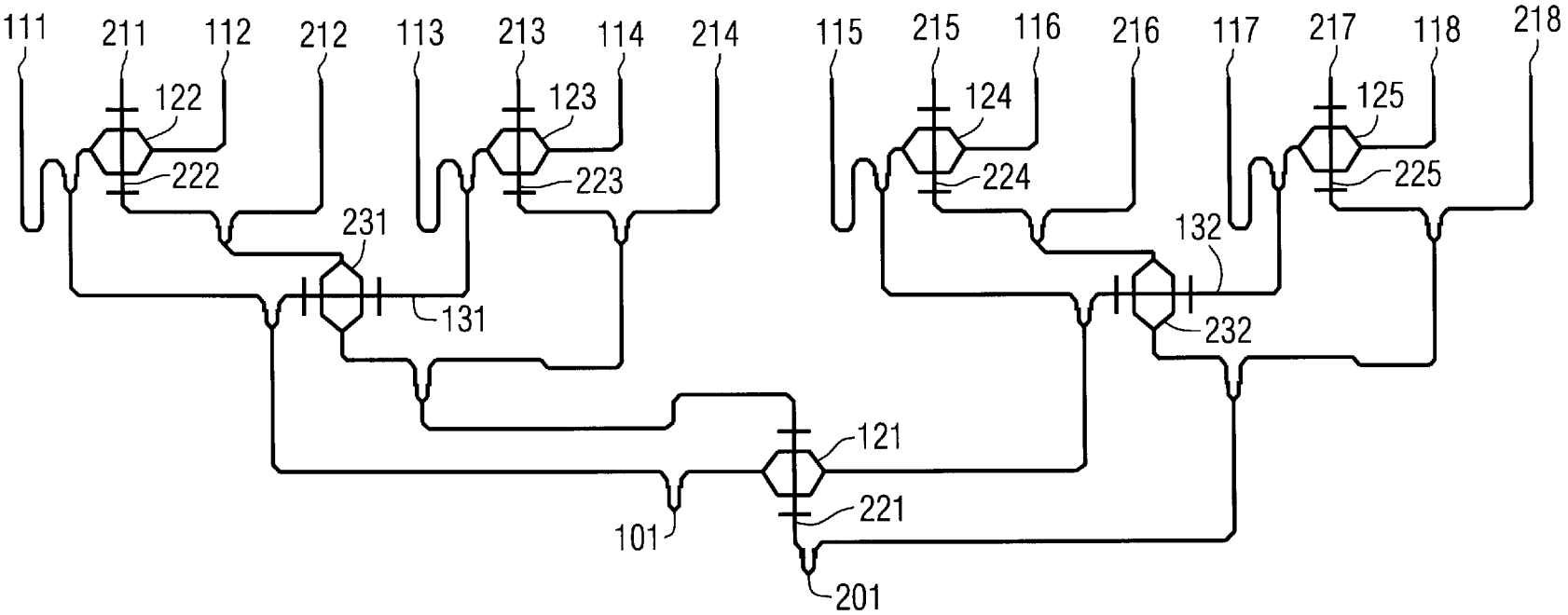

FIGS. 6, 7 and 8 are plan views of a multilayer signal distribution stripline architecture employing multiple ones of the stripline isolation cross-over of the type shown in FIGS. 4 and 5, that provide isolation for a pair of eight-way power dividers installed in a common laminate structure. In particular, FIG. 6 shows a first eight-way power divider 100, having an input port 101 to which a first signal is supplied, and a plurality of (eight) output ports 111, 112, 113, 114, 115, 116, 117, 118, from which a first plurality of output signals corresponding to divided versions of the first signal are derived. A first stripline-configured signal distribution network 120 is coupled between the input port 101 and the output ports 111, 112, 113, 114, 115, 116, 117, 118, and is configured to divide the first signal into eight output signals at output ports 111, 112, 113, 114, 115, 116, 117, 118. Also shown at 121, 122, 123, 124, 125 in the signal distribution network of FIG. 6 are five back-to-back connected power divider stripline isolation cross-over arrangements, an individual one of which is shown in FIGS. 4 and 5. As shown in FIG. 8, the five stripline isolation cross-overs 121, 122, 123, 124, 125 are located at five spatial positions of the network 100 that mutually overlap respective sections 121, 122, 123, 124, 125 of stripline of the signal distribution network of FIG. 7, when the two networks are overlaid upon one another to form a laminate architecture.

Similarly, FIG. 7 shows a second eight-way power divider 200 having an input port 201, to which a second signal is supplied, and a plurality of (eight) output ports 211, 212, 213, 214, 215, 216, 217, 218, from which a plurality of output signals corresponding to divided versions of the second signal are derived. A second stripline-configured signal distribution network 220 is coupled between input port 201 and the plurality of output ports 211, 212, 213, 214, 215, 216, 217, 218, and is configured to distribute the divided second signal as eight output signals at ports 211, 212, 213, 214, 215, 216, 217, 218. The signal distribution network of FIG. 7 includes two cross-overs 231 and 232 of the stripline isolation cross-overs shown in FIGS. 4 and 5. The isolation cross-overs 231 and 232 are located at spatial positions of network 200 that mutually overlap stripline sections 131 and 132 of the signal distribution network of FIG. 6.

From an examination of FIGS. 6, 7 and 8, it can be seen that the signal distribution network 100 of FIG. 6 and the network 200 of FIG. 7, when mutually overlaid in plan as shown in FIG. 8, not only provide separate access to input ports 101 and 201, and allow output ports 111, 112, 113, 114, 115, 116, 117, 118 and 211, 212, 213, 214, 215, 216, 217, 218 to be interleaved with one another (thereby facilitating connections to separate sets of signal output components, such as individual antenna elements of a phased array antenna system), but do so without signals in either network being coupled to any of the output ports of the other network. Also shown in FIG. 8 are striplines sections 131 and 132 and isolation cross-overs 231 and 232.

Namely, the five stripline isolation cross-overs 121, 122, 123, 124, 125 of the signal distribution network 100 of FIG. 6 and the two stripline isolation cross-overs 231 and 232 of the network 200 of FIG. 7 allow each of the signal distribution networks 100 and 200 is able to distribute input signals to its intended plurality of output ports, without mutual interference. Thus, signals distributed by network 100 are not coupled to any of the output ports of network 200, and signals distributed by network 100 are not coupled to any of the output ports of network 100. As noted previously, this is accomplished without having to use an intermediate ground-shielding layer and an additional dielectric layer between the two signal distribution networks.

This improvement becomes particularly marked, as the number of signal distribution networks within a laminate architecture increases. The crosstalk cancellation architecture of the present invention employs only one more dielectric layer than the number of signal distribution networks, and no intermediate grounded shielding layers in addition to those of the outer shielding layers. A conventional laminate architecture, however, requires an additional dielectric layer and an additional grounded shielding layer for each signal distribution network in excess of one, thereby considerably increasing the volume, weight and cost of the signal distribution architecture compared to the compact structure of the invention.

As will be appreciated from the foregoing description, the above-described cross-talk problem encountered in highly compact and densified multilayer RF signal distribution/feed networks is successfully addressed by the stripline isolation cross-over of the present invention, which is configured to effectively cancel signals that may be mutually coupled at cross-over points between adjacent stripline networks within a compact multilayer signal distribution architecture, without the need for an intermediate grounded shielding layer between adjacent ones of the stacked signal distribution networks.

Respectively different spatial configurations of various signal distribution network employing the stripline cross-over of the present invention may be defined such that adjacent networks, when mutually overlaid in the laminate structure, provide separate access to signal input ports, and allow the respective output ports thereof to be placed in a desired spatial arrangement, such as at antenna elements of a phased array antenna, but without signals distributed by any one network being coupled to any of the output ports of any other network.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed:

1. A signal coupling network comprising:

a first conductor extending in a first direction; and a second conductor extending in a second direction, having a region thereof crossing over a region of said first conductor, and being spaced apart from said first conductor by a first dielectric layer therebetween; and wherein said region of said second conductor includes a signal divider having a first port thereof coupled to a first portion of said second conductor located adjacent to a first side of said region of said first conductor, and second and third ports thereof spaced apart from one another by a half wavelength of said signal, and a signal combiner having a first port thereof coupled to a second portion of said second conductor located adjacent to a second side of said region of said first conductor, and second and third ports thereof spaced apart from one another by said half wavelength of said signal, and wherein said second and third ports of said signal divider are respectively coupled to said second and third ports of said signal combiner; and wherein said second and third ports of said signal divider are respectively coupled to said second and third ports of said signal combiner by way of first and second conductor links spaced apart by said half wavelength in the course of crossing over said first conductor, and further including tuning pads spaced apart from said first and second conductor links, spaced apart from and overlying said first conductor.

2. A signal coupling network according to claim 1, wherein each of said signal divider and said signal combiner is respectively configured in the manner of a resistorless Wilkinson splitter.

3. A signal coupling network according to claim 1, wherein each of said signal divider and said signal combiner is respectively configured exclusive of an isolation resistor.

4. A signal coupling network according to claim 1, further including a first ground layer spaced apart from said first conductor by a second dielectric layer therebetween, and a second ground layer spaced apart from said second conductor by a third dielectric layer therebetween.

5. A stripline isolation cross-over for canceling signals coupled between mutually overlapping stripline networks within a multilayer signal distribution architecture, comprising a signal-splitting power divider intercoupled with a signal combining power combiner, installed in a first section of stripline where said first section of stripline overlaps a second section of stripline, and being intercoupled by respective conductors crossing over locations of said second section of stripline and electrically spaced apart by a half-wavelength of a transported signal, thereby effectively canceling crosstalk and preventing mutual interference between said first and second sections of stripline; and further including tuning pads parallel said conductors crossing over said second section of stripline, and spaced apart therefrom by a distance equal to a quarter wavelength of said transported signal.

6. A stripline isolation cross-over according to 5, further including a first shielding layer overlying said first section of stripline, and a second shielding layer overlying said second section of stripline.

7. A stripline isolation cross-over architecture comprising:

a first dielectric layer;

a first stripline layer extending in a first direction on a first side of said first dielectric layer; and a second stripline layer extending in a second direction on a second side of said first dielectric layer, and having a signal isolation region that crosses over said first stripline layer, and includes a power divider having a common port thereof coupled to a first portion of said second stripline layer adjacent to a first side of said first stripline layer, and divided power ports thereof, and a power combiner having a common port thereof coupled to a second portion of said second stripline layer adjacent to a second side of said first stripline layer, and combining power ports thereof, and third and fourth stripline layers, respectively coupling said divided power ports of said power divider with said combining power ports of said power combiner, and crossing over said first stripline layer at locations spaced apart from one another by a half wavelength of signals transported by said first stripline layer; and further including tuning pads extending in said second direction on said second side of said first dielectric layer, and being spaced apart from said third and fourth stripline layers by a quarter wavelength of said signals.

8. A stripline isolation cross-over architecture according to claim 7, further including a first ground layer spaced apart from said first stripline layer by a second dielectric layer therebetween, and a second ground layer spaced apart from said second stripline layer by a third dielectric layer therebetween.

9. A stripline isolation cross-over architecture comprising:

first and second input ports to which first and second signals are respectively supplied;

a first plurality of output ports from which a first plurality of output signals corresponding to divided versions of said first signal are derived;

a second plurality of output ports from which a second plurality of output signals corresponding to divided versions of said second signal are derived; and a stripline-configured signal distribution network coupling said first and second input ports, respectively, with said first and second pluralities of output ports, and being operative to divide said first signal into said first plurality of output signals, and to divide said second signal into said second plurality of output signals, respectively, while preventing said first signal from being coupled to said second plurality of output ports, and preventing said second signal from being coupled to said first plurality of output ports, said stripline-configured signal distribution network comprising a first dielectric layer;

a first stripline layer having a first signal distribution pattern on a first side of said first dielectric layer between said first input port and said first plurality of output ports; and a second stripline layer having a second signal distribution pattern on a second side of said first dielectric layer between said first second port and said second plurality of output ports, and a plurality of first signal isolation regions that cross over said first stripline layer, a respective one of said plurality of first signal isolation regions including a first power divider having a common port thereof coupled to a first portion of said second stripline layer adjacent to a first side of said first stripline layer, and divided power ports thereof, and a first power combiner having a common port thereof coupled to a second portion of said second stripline layer adjacent to a second side of said first stripline layer, and combining power ports, and third and fourth stripline layers, respectively coupling said divided power ports of said first power divider with said combining power ports of said first power combiner, and crossing over said first stripline layer at locations spaced apart from one another by a half wavelength of said first signals transported by said first stripline layer; and further including first tuning pads on said second side of said first dielectric layer, and being spaced apart from said third and fourth stripline layers by a quarter wavelength of said first signals.

10. A stripline isolation cross-over architecture comprising:

first and second input ports to which first and second signals are respectively supplied;

a first plurality of output ports from which a first plurality of output signals corresponding to divided versions of said first signal are derived;

a second plurality of output ports from which a second plurality of output signals corresponding to divided versions of said second signal are derived; and a stripline-configured signal distribution network coupling said first and second input ports, respectively, with said first and second pluralities of output ports, and being operative to divide said first signal into said first plurality of output signals, and to divide said second signal into said second plurality of output signals, respectively, while preventing said first signal from being coupled to said second plurality of output ports, and preventing said second signal from being coupled to said first plurality of output ports, said stripline-configured signal distribution network comprising a first dielectric layer;

a first stripline layer having a first signal distribution pattern on a first side of said first dielectric layer between said first input port and said first plurality of output ports; and a second stripline layer having a second signal distribution pattern on a second side of said first dielectric layer between said first second port and said second plurality of output ports, and a plurality of first signal isolation regions that cross over said first stripline layer, a respective one of said plurality of first signal isolation regions including a first power divider having a common port thereof coupled to a first portion of said second stripline layer adjacent to a first side of said first stripline layer, and divided power ports thereof, and a first power combiner having a common port thereof coupled to a second portion of said second stripline layer adjacent to a second side of said first stripline layer, and combining power ports, and third and fourth stripline layers, respectively coupling said divided power ports of said first power divider with said combining power ports of said first power combiner combiner, and crossing over said first stripline layer at locations spaced apart from one another by a half wavelength of said first signals transported by said first stripline layer, and wherein said first stripline layer has a plurality of second signal isolation regions that cross under said second stripline layer, a respective one of said plurality of second signal isolation regions including a second power divider having a common port thereof coupled to a first portion of said first stripline layer adjacent to a first side of said second stripline layer, and divided power ports thereof, and a second power combiner having a common port thereof coupled to a second portion of said first stripline layer adjacent to a second side of said second stripline layer, and combining power ports thereof, and fifth and sixth stripline layers, respectively coupling said divided power ports of said second power divider with said combining power ports of said second power combiner, and crossing under said second stripline layer at locations spaced apart from one another by a half wavelength of said second signals transported by said second stripline layer.

11. A stripline isolation cross-over architecture according to 10, further including first tuning pads on said first side of said first dielectric layer, and being spaced apart from said fifth and sixth stripline layers by a quarter wavelength of said second signals, and second tuning pads on said second side of said first dielectric layer, and being spaced apart from said third and fourth stripline layers by a quarter wavelength of said first signals.

* * * * *